US006695097B1

(12) United States Patent
Wiklund

(10) Patent No.: US 6,695,097 B1
(45) Date of Patent: Feb. 24, 2004

(54) CONSTRUCTION HOIST SYSTEM

(75) Inventor: Sven-Erik Wiklund, Skellefteå (SE)

(73) Assignee: Alimak AB, Skelleftea (SE)

( * ) Notice: Subject to any disclaimer, the term of this patent is extended or adjusted under 35 U.S.C. 154(b) by 0 days.

(21) Appl. No.: 09/623,675

(22) PCT Filed: Mar. 26, 1999

(86) PCT No.: PCT/SE99/00492

§ 371 (c)(1),
(2), (4) Date: Sep. 7, 2000

(87) PCT Pub. No.: WO99/50167

PCT Pub. Date: Oct. 7, 1999

(30) Foreign Application Priority Data

Mar. 27, 1998 (SE) ..... 9801065

(51) Int. Cl.[7] ..... E04G 1/20
(52) U.S. Cl. ..... 182/141; 182/145
(58) Field of Search ..... 182/141, 145, 182/146, 136, 132

(56) References Cited

U.S. PATENT DOCUMENTS 3,323,616 A * 6/1967 Best ..... 182/146
3,516,512 A * 6/1970 Kupke ..... 182/141
4,262,773 A * 4/1981 Basham ..... 182/132
4,293,054 A * 10/1981 Pieri ..... 182/146
4,294,332 A * 10/1981 Ready
4,619,346 A * 10/1986 Deguerry ..... 182/141
4,809,814 A * 3/1989 St-Germain ..... 182/132
5,159,993 A * 11/1992 St-Germain ..... 182/146
5,259,479 A * 11/1993 St-Germain ..... 182/146
5,555,952 A * 9/1996 van Mol et al. ..... 182/18
5,579,865 A * 12/1996 Butler et al. ..... 182/141
6,095,285 A * 8/2000 St-Germain
6,311,800 B1 * 11/2001 St-Germain

FOREIGN PATENT DOCUMENTS

| | | |
|---|---|---|
| DE | 3426985 A1 | 3/1985 |
| SE | 8006848 | 5/1982 |
| SE | 462 336 | 6/1990 |

* cited by examiner

*Primary Examiner*—Alvin Chin-Shue
(74) *Attorney, Agent, or Firm*—Nixon & Vanderhye P.C.

(57) ABSTRACT

A versatile construction hoist system comprises a hoist trolley having a first pair of connection members, and a work platform having a second pair of connection members. The work platform is releasably connectable to the trolley through interconnection of the first and second pairs of connection members with the work platform in a horizontal position in which the work platform floor is situated at the first level relative the trolley. A transport platform, which has a third pair of connection members, is releasably connectable to the trolley through interconnection of the first and third pairs of connection members with the transport platform in a horizontal position in which its floor is situated at a second level relative the trolley, said second level being below said first level. An adapter enables use of standard transport platform elements.

11 Claims, 5 Drawing Sheets

CONSTRUCTION HOIST SYSTEM

CROSS REFERENCE TO RELATED APPLICATION

This application is a U.S. national phase of PCT/SE99/00492 filed Mar. 26, 1999.

BACKGROUND AND SUMMARY OF THE INVENTION

The present invention relates to a construction hoist system, comprising at least one mast having two adjacent parallel corner rails, a trolley running on the corner rails, and a motor on the trolley for driving the trolley along the corner rails. The system further comprises a first pair of connection members on the trolley, a work platform having a substantially flat work floor, and a second pair of connection members on the work platform. The work platform is releasably connectable to the trolley through interconnection of the first and second pairs of connection members with the work platform in a horizontal position in which the work floor is situated at a first level relative the trolley.

Such a construction hoist system is disclosed in SE-B-462 336. At one end the work platform of this known system is hinged on the trolley through the first and second pairs of connection members, and at the opposite end the work platform is hinged to another trolley on another adjacent mast through further pairs of connection members similar to said first and second pairs of connection members. As a result the work platform is allowed to tilt somewhat as it is hoisted or lowered between the two adjacent masts. A levelling device controls the trolley motors on the respective masts in response to sensors sensing the deviation of the work platform from a desired normal horizontal position of the work platform, so that the work platform substantially maintains its horizontal position during hoisting and lowering. Thus, the known system is limited to a two-mast configuration.

The prime object of the present invention is to provide a new construction hoist system, which is more versatile than the above known system and which is not limited to a two-mast configuration but can include a single-mast configuration as well.

Another object of the invention is to provide a versatile construction hoist system comprising simple and easy-to-use components to facilitate tailor-made configurations of the system for any buildings.

These objects are obtained by the construction hoist system described initially, which is characterised by a transport platform having a substantially flat load carrier floor, and a third pair of connection members provided on the transport platform, the transport platform being releasably connectable to the trolley through interconnection of the first and third pairs of connection members with the transport platform in a horizontal position in which the load carrier floor is situated at a second level relative the trolley, said second level being below said first level.

As a result, the advantage is obtained that besides the option of connecting the work platform, typically of a conventional type with a raised work floor, to the trolley there is also the alternative option of connecting the transport platform, typically with a low load carrier floor, to the trolley. Said second level relative the trolley is suitably selected so that the load carrier floor of the transport platform is close to or rests on the ground when the trolley is in its lowermost position on the mast, in order to facilitate material handling, i.e. loading and unloading the transport platform.

The construction hoist system of the invention preferably comprises an adapter having said third pair of connection members and being releasably connected to the transport platform. The adapter enables use of conventional types of transport platforms, which is cost beneficial.

In accordance with a simple and inexpensive design of the adapter, the adapter comprises a lateral beam, and two spaced apart posts extending upwardly from the lateral beam, said third pair of connection members being formed on the posts at their upper free ends.

For a single mast configuration, when the transport platform is relatively short, typically extending not longer than about 1.5 meters from the trolley, the construction hoist system of the invention suitably comprises a horizontal support beam, which is releasably attachable to the lateral beam of the adaptor to form a rigid unit consisting of the support beam and the adaptor. The support beam is releasably attachable to the trolley in such a manner that the load carrier floor of the transport platform is fixed in a horizontal position when the transport platform is attached to the trolley through the support beam.

In the case when the transport platform is relatively long, typically from two to about six meters, the construction hoist system of the invention comprises an additonal mast with an additional trolley, and an additional adapter, which is releasably connected to the transport platform at an end therof which is opposite the end of the platform which is provided with said first-mentioned adapter.

Suitably, said third pair of connection members of the first-mentioned adapter are hingeable on said first pair of connection members of the trolley and the pair of connection members on the additional adapter are hingeable on an additional pair of connection members on the additional trolley, such that the transport platform is tiltable about a horizontal axis through said third and first pairs of connection members and about a horizontal axis through the pairs of connection members on the additional trolley and the additional adapter.

BRIEF DESCRIPTION OF THE DRAWINGS

The construction hoist system of the present invention is explained in more detail in the following with reference to the accompanying drawings, in which.

DETAILED DESCRIPTION OF THE DRAWINGS

Figure 1:
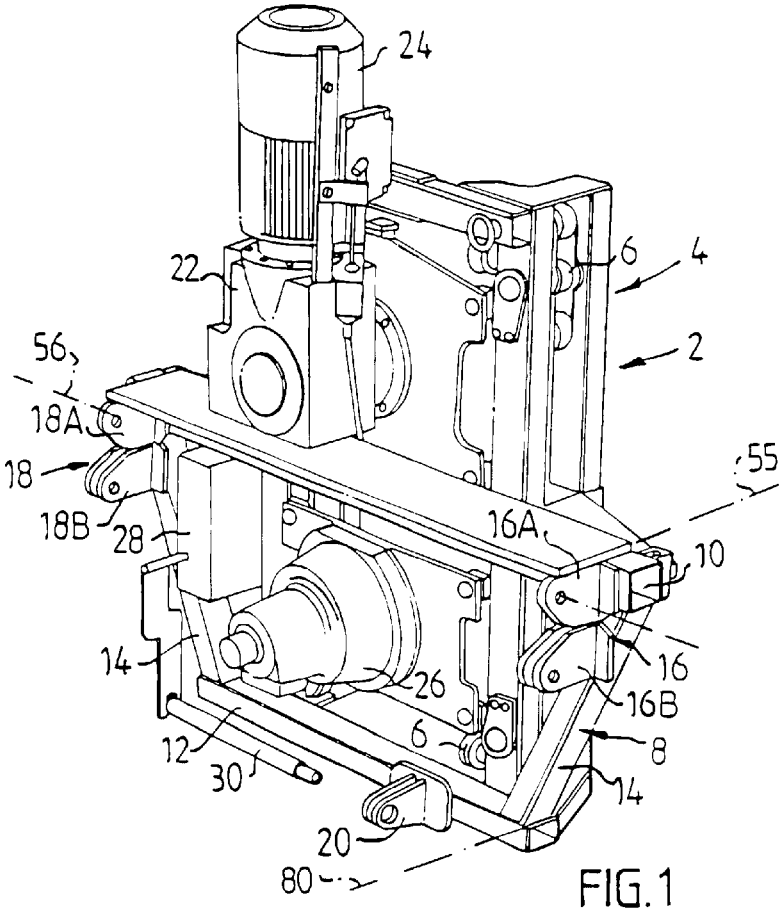
FIG. 1 is a perspective view of a trolley of the construction hoist system of the invention.

FIG. 1 shows a trolley 2 in accordance with the construction hoist system of the present invention comprising a generally rectangular vertically extending trolley frame 4, guide wheels 6 journalled on the trolley frame 4, and a platform connection frame 8 rigidly attached to the trolley frame 4. The platform connection frame 8 has a horizontal top beam 10, a horizontal lower beam 12, and two side beams 14 tapering from the top beam 10 to the lower beam 12. Two upper connection members 16 and 18 are mounted on the top beam 10 at opposite ends thereof, and a lower connection member 20 in the shape of a bracket is releasably attached to the lower beam 12. Each upper connection member 18 comprises a single bracket 18A with a horizontal hinge hole and an adjacent double bracket 18B with horizontal hinge holes. A mitre-wheel gearing 22 with an electric motor 24 is mounted on the upper part of the trolley frame 4 and a safety device 26 of a well-known type is mounted on the lower part of the trolley frame 4. On the lower part of the trolley frame 4 there is also mounted a level sensor 28 with a lever arm 30.

Figure 2:
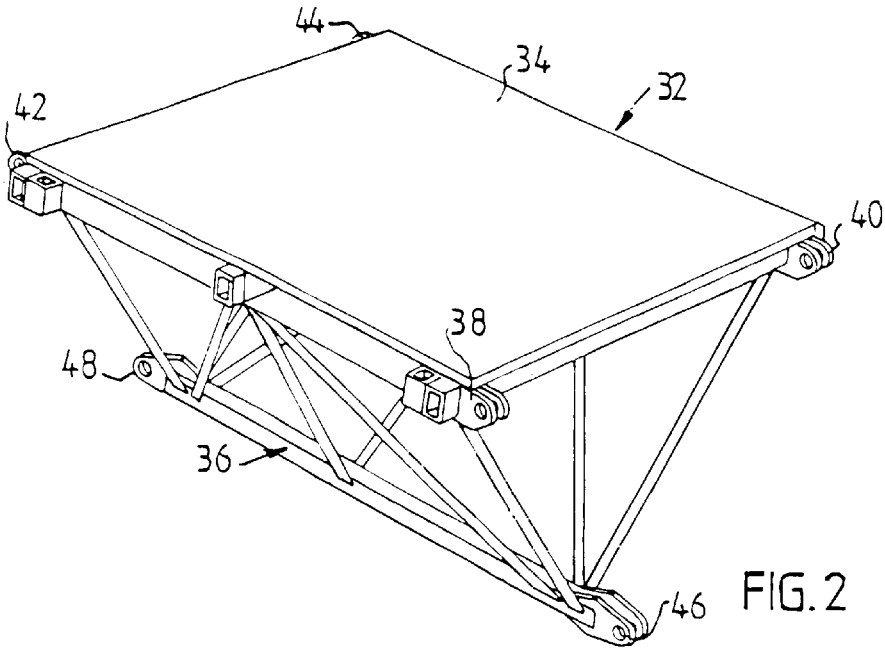
FIG. 2 is a perspective view of a work platform section fitting the trolley in FIG. 1.

FIG. 2 shows a rectangular work platform section 32 of a conventional design comprising a work floor 34 and a strengthening framework structure 36 under the work floor 34. As shown in FIG. 2 there are two upper right connection members 38 and 40 rigidly attached to two adjacent corners of the work floor 34, two upper left connection members 42 and 44 rigidly attached to the other two corners of the rectangular work floor 34, and lower right and left connection members 46 and 48, respectively, rigidly attached to the lower part of the framework structure 36. Each upper right connection member 38,40 is designed as a double bracket with horisontal hinge holes, whereas each upper left connection member 42,44 is designed as a single bracket with a horizontal hinge hole. Likewise, the lower right connection member 46 is designed as a double bracket, whereas the lower left connection member 48 is designed as a single bracket.

Figure 4:
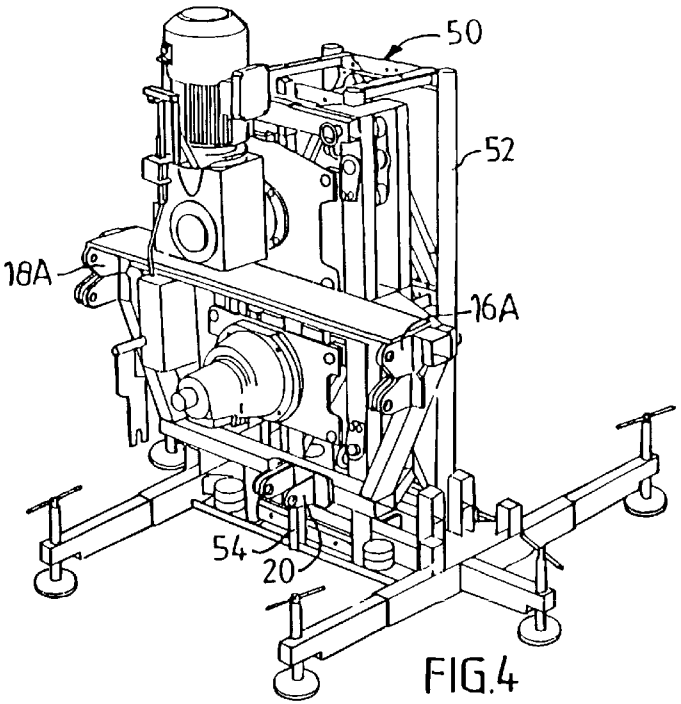
FIG. 4 is a perspective view of a trolley of the type shown in FIG. 1 running on a right mast.
Figure 4A:
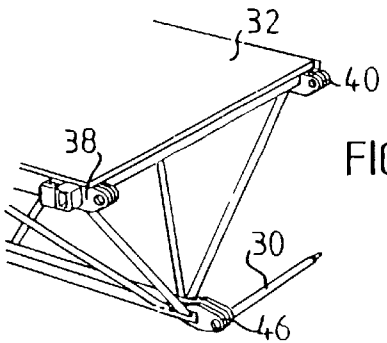
FIG. 4A is a perspective view of the right end of the work platform of FIG. 2.

The construction hoist system of the invention further comprises at least one mast 50 having four vertical corner rails 52 and at least one vertical rack 54, see FIG. 4. The trolley 2 runs by means of its guide wheels 6 on two adjacent corner rails 52. A pinion, not shown, of the gearing 22 is in mesh with the rack 54 to enable the motor 24 to drive the trolley 2 along the mast 50. However, other types of transmissions, such as cable and pulley transmission, may be substituted for the described rack and pinion transmission.

In a single mast configuration, the work platform section 32 is hinged to the trolley 2 by interconnecting the upper right double brackets 38,40 of the work platform section 32 and the upper single brackets 16A,18A of the connection frame 8 by means of hinge pins, not shown, extending through the horizontal holes of the brackets. In this case the lower right double bracket 46 of the work platform section 32 is secured to the lower bracket 20 of the connection frame 8, so that the work floor 34 extends horizontally from the trolley 2. As a result, the work floor 34 is situated at an upper level 55 relative the trolley 2.

Figure 3:
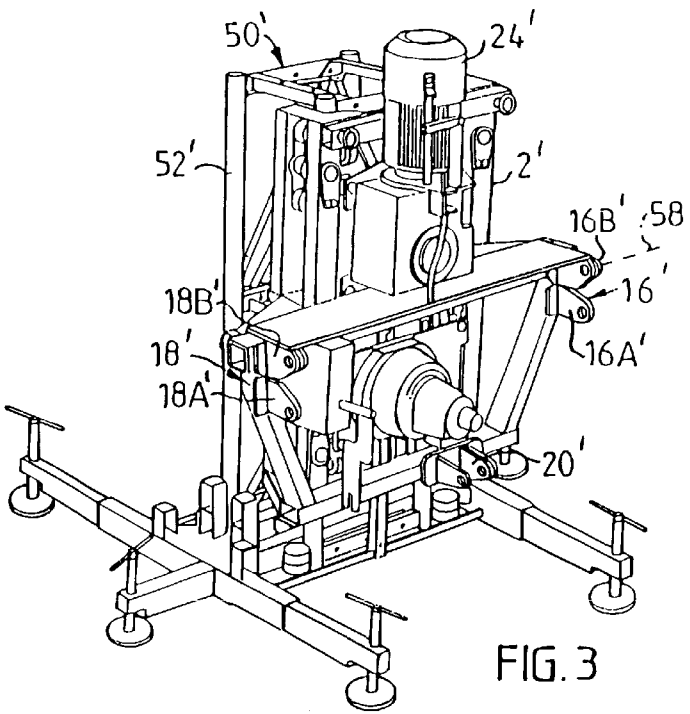
FIG. 3 is a perspective view of a trolley of the type shown in FIG. 1 runing on a left mast.
Figure 3A:
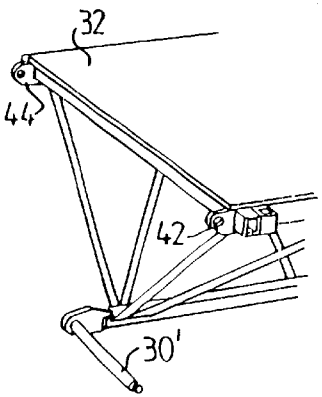
FIG. 3A is a perspective view of the left end of the work platform of FIG. 2.

If desired, a number of work platforms sections 32 may be interconnected by means of the brackets 38–48, to form a longer work platform 32, up to about 19 meters would be possible. In such a case, the construction hoist system of the invention provides a double mast configuration as will be explained with reference to FIGS. 3 and 4. The components shown in FIG. 3 which correspond to the components shown in FIGS. 1, 2 and 4 have the same reference numerals with the addition of a "prime". An additional mast 50' with an additional trolley 2' is provided to be connected to the left end of the work platform 32. The additional trolley 2' is equivalent to the trolley 2, except that the upper connection members 16',18' of the trolley 2' are turned upside down, so that the double brackets 16B',18B' are situated above the single brackets 16A',18A'. As a result the upper left single brackets 42,44 of the work platform 32 fit the double brackets 16B',18B' of the trolley 2'.

In the same manner as described above in connection with the single mast configuration, the right end of the work platform 32 is hinged to the trolley 2 by means of the brackets 16A,18A,38,40. The lower bracket 46 of the work platform 32 is connected to the lever arm 30. Likewise, the left end of the work platform 32 is hinged to the trolley 2'. As a result, the work platform 32 is tiltable about a horizontal axis 56 through the brackets 16A,18A,38,40 and about a horizontal axis 58 through the brackets 16B',18B', 42,44. A levelling device, known per se, controls the trolley motors 24,24' in response to the level sensors 28,28' sensing the deviation of the work platform 32 from a desired horizontal position of the work platform, so that the work platform 32 substantially maintains its horizontal position during hoisting and lowering.

Figure 5:
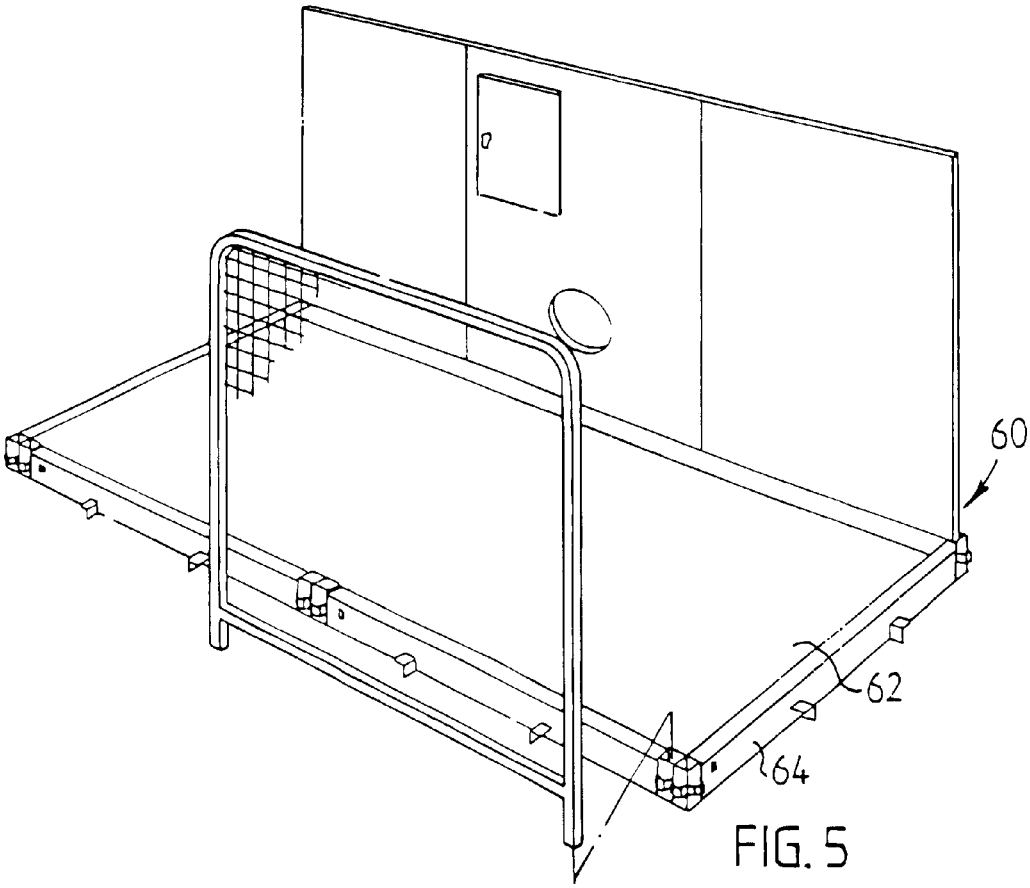
FIG. 5 is a perspective view of a transport platform of the construction hoist system of the invention.
Figure 6:
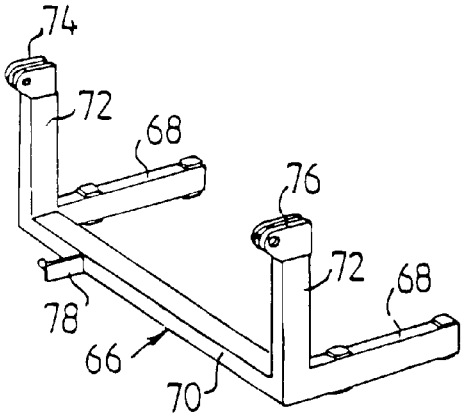
FIG. 6 is a perspective view of an adapter fitting the trolley in FIG. 3.

FIG. 5 shows a rectangular transport platform 60 in accordance with the construction hoist system of the invention, comprising a load carrier floor 62 mounted on a rectangular frame 64. An adapter 66 for the transport platform 60 comprises two parallel fork elements 68, which are attachable to the frame 64 at each short end of the transport platform 60, a lateral beam 70 extending between the fork elements 68, and two spaced apart posts 72 extending vertically upwardly from the lateral beam 70. Two double brackets 74 and 76 of the same type as the brackets 38, 40 on the work platform 32 are attached to the posts 72 at their upper free ends. A connection element 78 projects from the lateral beam 70.

Figure 8:
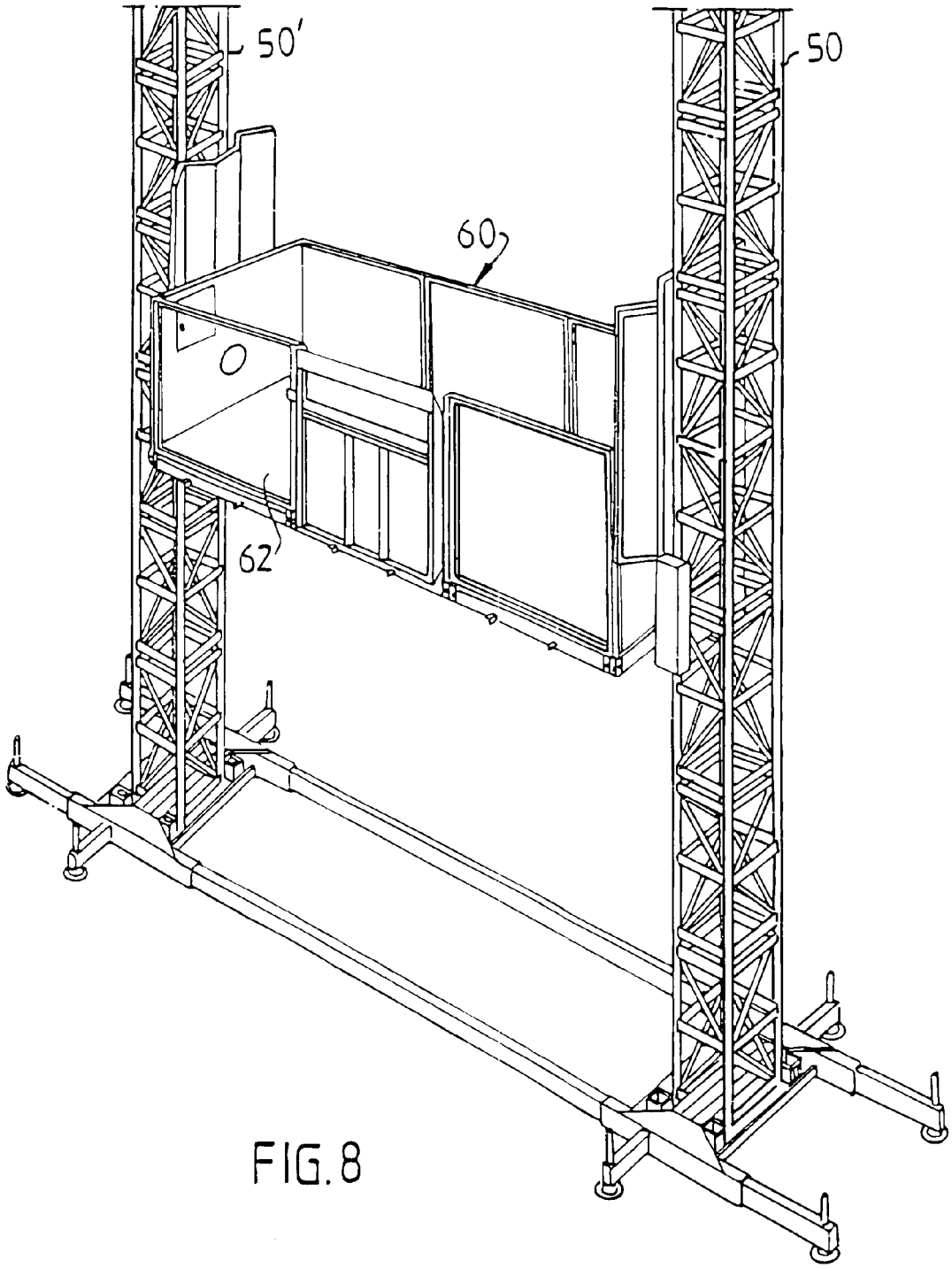
FIG. 8 illustrates a two-mast configuration according to the construction hoist system of the invention, comprising a transport platform of the type of FIG. 5 connected to the trolleys of FIGS. 3 and 4 with the aid of two adapters of the type shown in FIG. 6, and FIGS. 9 and 10 illustrate tailor-made examples of the construction hoist system of the invention.

With the transport platform 60 provided with two adapters 66, of which one has single brackets attached to the posts 72, the transport platform 60 is connectable to the trolleys 2 and 2' in substantially the same manner as described above for the connection of the work platforms to the trolleys 2,2' see FIG. 8. The lever arms 30 and 30' are attached to the respective connection elements 78. As a result, the transport platform is tiltable about the horizontal axes 56 and 58. When the transport platform 60 is in a horizontal position the carrier load floor 62 is situated at a level 80 relative the trolley 2 well below said level 55 of the work floor of the work platform 32.

Figure 7:
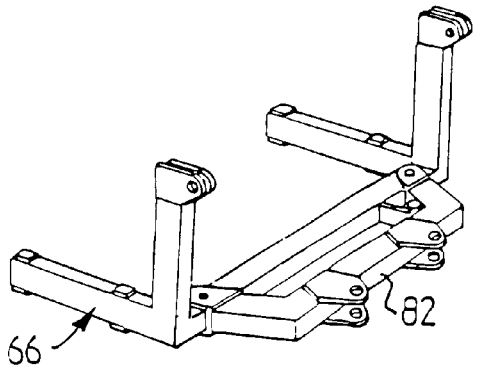
FIG. 7 is a perspective view of an adapter of the same type as the adapter of FIG. 6, but provided with a support beam and fitting the trolley of FIGS. 1 and 4, respectively.

In the case of a single mast configuration, a support beam 82 is releasably attached to the adapter 66 as illustrated in FIG. 7. When the transport platform 60 provided with one adapter 66 is connected to the trolley 2, the support beam 82 is releasably attached to the lower beam 12 of the connection frame 8 on the trolley 2.

Figure 10:
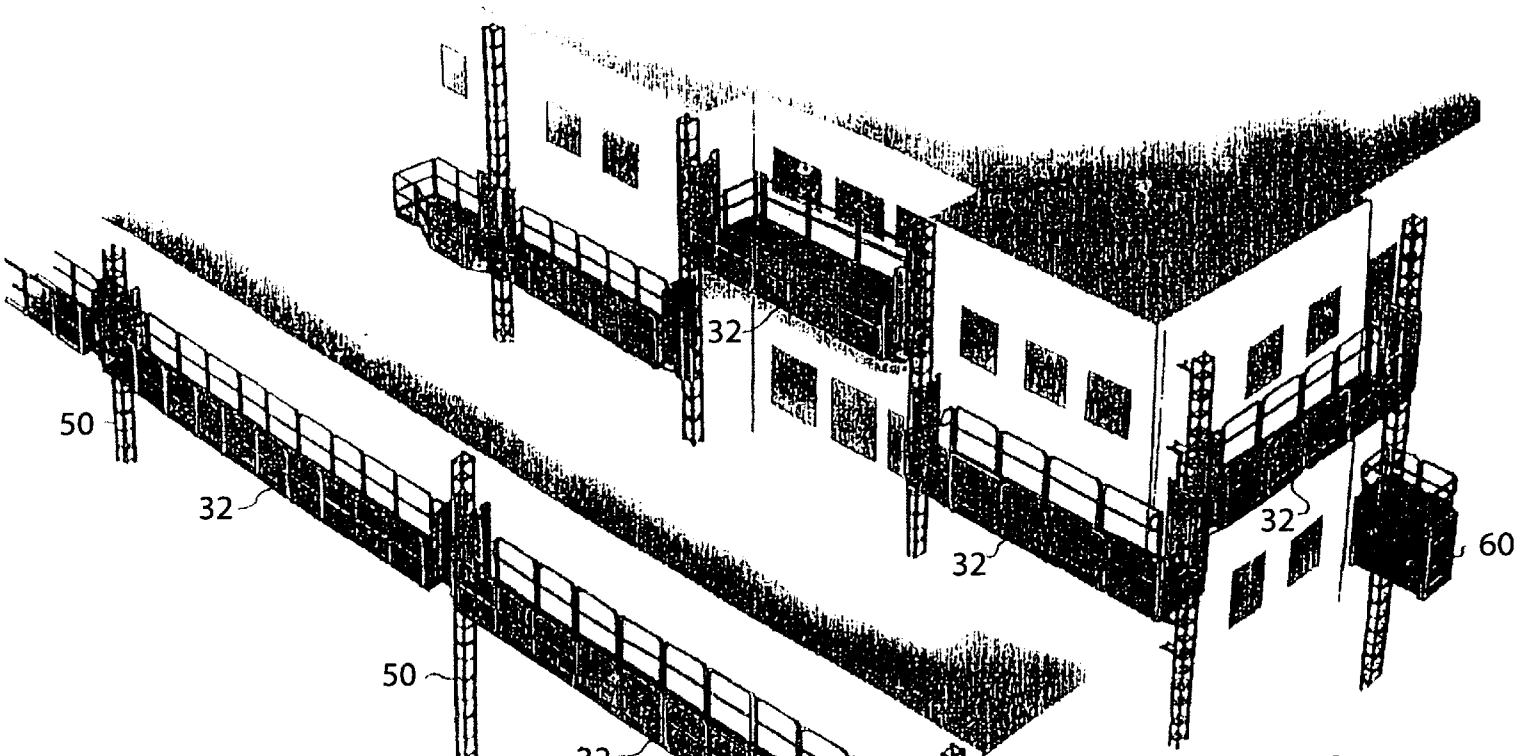
Figure 9:
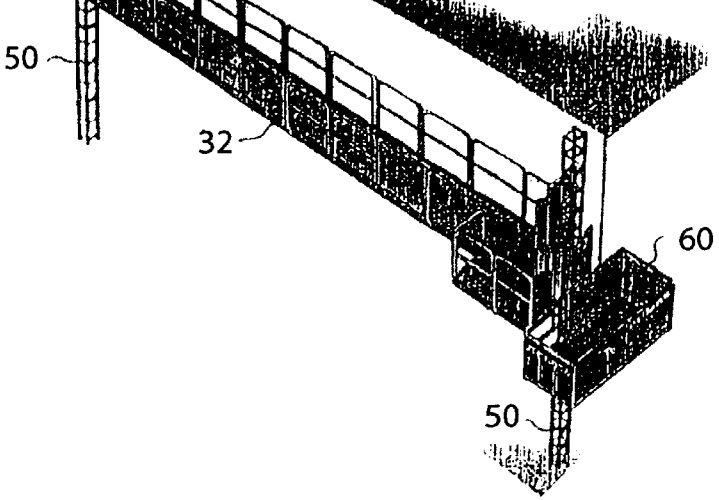

Accordingly, the components of the construction hoist system of the present invention including masts 50, trolleys 2, work platforms 32, transport platforms 60 and adapters 66 with or without support beams 82 enable tailor-made configurations for any buildings, as by way of example are schematically illustrated in FIGS. 9 and 10.

What is claimed is:

1. A construction hoist system, comprising:

a single mast having two adjacent parallel corner rails, a trolley mounted on said corner rails to roll up and down on said corner rails, a motor on said trolley for driving said trolley along said corner rails, a first pair of connection members on said trolley, a work platform constructed separately from said trolley, said work platform including a substantially flat work floor and a second pair of connection members, said work platform being releasably connected to and fully supported by said trolley alone through interconnection of said first and second pairs of connection members with said work platform in a horizontal position in which said work floor is situated at a first level relative to said trolley, a transport platform constructed separately from said trolley, said transport platform including a substantially flat load carder floor and an adaptor releaseably connected to the transport platform, said adaptor having a third pair of connection members, said transport platform being releasably connected to and fully supported by said trolley alone alternatively to said work platform through interconnection of said first and third pairs of connection members, said adaptor having a vertical length which allows attachment of said transport platform to the trolley in a horizontal position in which said load carrier floor is situated at a second level relative to said trolley, said second level being below said first level.

2. A construction hoist system comprising:

a single mast having two adjacent parallel corner rails, a trolley mounted on said corner rails to roll up and down on said corner rails, a motor on said trolley for driving said trolley along said corner rails, a first pair of connection members on said trolley, a separate work platform including a substantially flat work floor and a second pair of connection members, said work platform being releasably connectable to and fully supported by said trolley alone through interconnection of said first and second pairs of connection members with said work platform in a horizontal position in which said work floor is situated at a first level relative to said trolley, a separate transport platform including a substantially flat load carrier floor and a third pair of connection members, said transport platform being releasably connectable to and fully supported by said trolley alone alternatively to said work platform through interconnection of said first and third pairs of connection members with said transport platform in a horizontal position in which said load carrier floor is situated at a second level relative to said trolley, said second level being below said first level, and an adapter having said third pair fo connection members, said adapter being releasably connected to said transport platform, wherein said adapter comprises a lateral beam, and two spaced apart posts extending upwardly from said lateral beam, said third pair of connection members being formed on said posts at their upper free ends.

3. A construction hoist system according to claim 2, further comprising a horizontal support beam, which is releasably attachable to said lateral beam of said adapter to form a rigid unit consisting of said support beam and said adapter, said support beam being releasably attachable to said trolley, such that said load carrier floor of said transport platform is fixed in a horizontal position when said transport platform is attached to said trolley through said support beam.

4. A construction hoist system comprising:

a first mast and a second mast, each mast having two adjacent parallel corner rails, a first trolley and a second trolley mounted, respectively, on said corner rails of said first and second masts to roll upwardly and downwardly on said corner rails of said first mast and second mast, respectively, a first motor and a second motor on said first trolley and second trolley, respectively, for driving said trolleys along said corner rails, a first pair of connection members on said first trolley, a second pair of connection members on said second trolley, a work platform including a substantially flat work floor, a first end and a second end, and a third pair of connection members on said work platform at said first end, said work platform being releasably connectable to and fully supported by either:

said first trolley alone through interconnection of said first and third pairs of connection members, said second trolley alone through interconnection of said second and third pairs of connection members, or said first and second trolleys through interconnection of said first and third pairs of connection members and interconnection of said second pair of connection members and a fourth pair of connection members on said work platform at said second end, whereby said work floor of said work platform is situated at a first level relative to said first and/or second trolleys, when said work floor extends horizontally, a transport platform including a substantially flat load carrier floor, a first end and a second end, and a fifth pair of connection members provided on said transport platform at said first end thereof, said transport platform being releasably connectable to and fully supportable either by:

said first trolley alone through interconnection of said first and fifth pairs of connection members, said second trolley alone through interconnection of said second and fifth pairs of connection members, or said first and second trolleys through interconnection of said first and fifth pairs of connection members and interconnection of said second pair of connection members and a sixth pair of connection members provided on said transport platform at said second end thereof, whereby said load carrier floor of said transport platform situated at a second level relative to said trolleys below said first level, when said load carrier floor extends horizontally, and a first adapter having said fifth pair of connection members and a second adapter having said sixth pair of connection members, said adapters being releasably connected to said transport platform at said first and second ends thereof, wherein said first adapter and said second adapter, respectively, comprises a lateral beam, and two spaced apart posts extending upwardly from said lateral beam, said fifth pair of connection members being formed on said posts of said first adapter at their upper free ends and said sixth pair of connection members being formed on said posts of said second adapter at their upper free ends.

5. A construction hoist system according to claim 4, wherein said fifth pair of connection members of said transport platform are hingeable on said first pair of connection members of said first trolley and said sixth pair of connection members of said transport platform are hingeable on said second pair of connection members of said second trolley, such that said transport platform is tiltable about a horizontal axis through said fifth and first pairs of connection members and about a horizontal axis through said sixth and second pairs of connection members.

6. A construction hoist system comprising:

a first mast and a second mast, each mast having two adjacent parallel corner rails, a first trolley and a second trolley mounted, respectively, on said corner rails of said first and second masts to roll upwardly and downwardly on said corner rails of said first mast and second mast, respectively, a first motor and a second motor on said first trolley and second trolley, respectively, for driving said trolleys along said corner rails, a first pair of connection members on said first trolley, a second pair of connection members on said second trolley, a work platform constructed separately from said first and second trolleys, said work platform including a substantially flat work floor, a first end and a second end, and a third pair of connection members on said work platform at said first end, said work platform being releasably connected to and fully supported by either:

said first trolley alone through interconnection of said first and third pairs of connection members, said second trolley alone through Interconnection of said second and third pairs of connection members, or said first and second trolleys through interconnection of said first and third pairs of connection members and interconnection of said second pair of connection members and a fourth pair of connection members on said work platform at said second end, whereby said work floor of said work platform is situated at a first level relative to said first and/or second trolleys, when said work floor extends horizontally, a transport platform constructed separately from said first and second trolleys, said transport platform including a substantially flat load carrier floor, a first end and a second end, a first adaptor releaseably connected to the first end of the transport platform, and a fifth pair of connection members provided on the first adaptor of said transport platform at said first end thereof, said transport platform being releasably connected to and fully supportable either by:

said first trolley alone through interconnection of said first and fifth pairs of connection members, said second trolley alone through interconnection of said second and fifth pairs of connection members, or said first and second trolleys through interconnection of said first and fifth pairs of connection members and interconnection of said second pair of connection members and a sixth pair of connection members provided on a second adaptor releaseably connected to said transport platform at said second end thereof, the adaptors each having a vertical length which allows attachment of the transport platform to the trolleys, whereby said load carrier floor of said transport platform is situated at a second level relative to said trolleys below said first level, when said load carrier floor extends horizontally.

7. A construction hoist system comprising:

a first mast and a second mast, each of said masts having two rails, a first trolley and a second trolley running on said rails of said first mast and second mast, respectively, a first motor and a second motor on said first trolley and said second trolley, respectively, for driving said trolleys along said corner rails, a first pair of left and right connection members on said first trolley, each of said left and right connection members including a first single bracket and a first double bracket, and being positioned such that said first single bracket is above said double bracket, a second pair of left and right connection members on said second trolley, each of said second pair of left and right connection members including a second single bracket and a second double bracket, and being positioned such that said double bracket is above said second single bracket, first and second platforms constructed separately from said first and second trolleys, each of said platforms including a first end and a second end, said first platform including a third pair of double brackets provided at said first and thereof, said third pair of double brackets being releasably connected to said first single brackets of said first trolley such that said first platform is pivotable about a first horizontal axis through said first single brackets for leveling by a first leveling device mounted on said first trolley, and a third pair of single brackets provided on said first platform at said second end thereof and releasably connectable to said second double brackets of said second trolley such that said first platform is pivotable about a second horizontal axis through said second double brackets for leveling by a second leveling device mounted on said second trolley, the first platform including a first floor situated at a first level relative to the trolleys, said second platform including a first adaptor releaseably connected to the first end of the second platform and including a fourth pair of double brackets alternatively releasably connected to said first single brackets of said first trolley such that said second platform is pivotable about the first horizontal axis through said first single brackets for leveling by the first leveling device mounted on said first trolley, and a second adaptor releaseably connected to the second end of the second platform and including a fourth pair of single brackets alternatively releasably connected to said second double brackets of said second trolley such that said second platform is pivotable about the second horizontal axis through said second double brackets for leveling by the second leveling device mounted on said second trolley, the first and second adaptors each having a vertical length, whereby the second platform includes a second floor situated at a second level relative to the trolleys below the first level.

8. A construction hoist system comprising:

a first mast and a second mast, each of said masts having two rails, a first trolley and a second trolley running on said rails of said first mast and second mast, respectively, a first motor and a second motor on said first trolley and said second trolley, respectively, for driving said trolleys along said corner rails, a first pair of left and right connection members on said first trolley, each of said left and right connection members including a single bracket and a double bracket, and being positioned such that said single bracket is above said double bracket, a second pair of left and right connection members on said second trolley, each of said second pair of left and right connection members including a single bracket and a double bracket, and being positioned such that said double bracket is above said single bracket, first and second platforms, each of said platforms being constructed separately from said first and second trolleys and including:

a first end and a second end, a pair of double brackets provided at said first end thereof, said pair of double brackets being releasably connected to said single brackets of said first trolley such that said platform is pivotable about a first horizontal axis through said single brackets for leveling by a first leveling device mounted on said first trolley, and a pair of single brackets provided at said second end thereof, said pair of single brackets being releasably connected to said double brackets of said second trolley such that said platform is pivotable about a second horizontal axis through said double brackets for leveling by a second leveling device mounted on said second trolley, the first platform including a first floor situated at a first level relative to the trolleys, the second platform further including first and second adaptors releaseably connected, respectively, to the first and second ends thereof, the first and second adaptors including, respectively, the second platform's pair of double brackets and pair of single brackets, each of said adaptors having a vertical length which allows an attachment of the second platform to the trolleys in which a second floor of the second platform is situated at a second level relative to the trolleys below the first level.

9. A construction hoist system according to claim 8, wherein one of said platforms comprises a work platform having a substantially flat work floor that is situated at a first level when said work platform is in a horizontal position and connected to said first and second trolleys, and the other of said platforms comprises a transport platform having a substantially flat load carrier floor that is situated at a second level below the first level when said transport platform is in a horizontal position and connected to said first and second trolleys.

10. A construction hoist system comprising:

a first mast and a second mast, each of said masts having two rails, a first trolley and a second trolley running on said rails of said first mast and second mast, respectively, a first motor and a second motor on said first trolley and said second trolley, respectively, for driving said trolleys along said corner rails, a first pair of left and right connection members on said first trolley, each of said left and right connection members including a single bracket and a double bracket, and being positioned such that said single bracket is above said double bracket, a second pair of left and right connection members on said second trolley, each of said second pair of left and right connection members including a single bracket and a double bracket, and being positioned such that said double bracket is above said single bracket, two different platforms, each of said platforms being separate from said first and second trolleys and including, a first end and a second end, a pair of double brackets provided at said first end thereof, said pair of double brackets being releasably connectable to said single brackets of said first trolley such that said platform is pivotable about a first horizontal axis therethrough for leveling by a first leveling device mounted on said first trolley, and a pair of single brackets provided at said second end thereof, said pair of single brackets being releasably connectable to said double brackets of said second trolley such that said platform is pivotable about a second horizontal axis therethrough for leveling by a second leveling device mounted on said second trolley, one of said platforms comprising a work platform having a substantially flat work floor that is situated at a first level when said work platform is in a horizontal position and connected to said first and second trolleys, and the other of said platforms comprising a transport platform having a substantially flat load carrier floor that is situated at a second level below the first level when said transport platform is in a horizontal position and connected to said first and second trolleys, and a first adapter releasably connectable to said transport platform and having said pair of double brackets thereof, and a second adapter releasably connectable to said transport platform and having said pair of single brackets thereof, wherein said first adapter and said second adapter, respectively, comprises a lateral beam, and two spaced apart posts extending upwardly from said lateral beam and having upper free ends, said pair of double brackets of said first adapter being formed on said posts at said upper free ends and said pair of single brackets of said second adapter being formed on said posts at said upper free ends.

11. A construction hoist system comprising:

a single mast having two adjacent parallel corner rails, a trolley mounted on said corner rails to roll up and down on said corner rails, a motor on said trolley for driving said trolley along said corner rails, a first pair of connection members on said trolley, a separate work platform including a substantially flat work floor and a second pair of connection members, said work platform being releasably connectable to and fully supported by said trolley alone through interconnection of said first and second pairs of connection members with said work platform in a horizontal position in which said work floor is situated at a first level relative to said trolley, a separate transport platform including a substantially flat load carrier floor and a third pair of connection members, said transport platform being releasably connectable to and fully supported by said trolley alone alternatively to said work platform through interconnection of said first and third pairs of connection members with said transport platform in a horizontal position in which said load carrier floor is situated at a second level relative to said trolley, said second level being below said first level, said mast having two additional adjacent parallel corner rails, a second trolley rotatably mounted on said additional corner rails whereby the second trolley is free to run up and down on said additional corner rails, a second motor on said second trolley for driving said second trolley along said additional corner rails, and a fourth pair of connection members on said second trolley, said work platform being releasably connectable to said second trolley through interconnection of said second and fourth pairs of connection members with said work platform in a horizontal position in which said work floor is situated at a first level relative to said second trolley, said work platform being fully supported by said second trolley when connected to said second trolley, said transport platform being releasably connectable to said second trolley through interconnection of said third and fourth pairs of connection members with said transport platform in a horizontal position in which said load carrier floor is situated at a second level relative to said second trolley, said second level relative to said second trolley being below said first level relative to said second trolley, said transport platform being fully supported by said second trolley when connected to said second trolley.

* * * * *